US007357360B2

(12) United States Patent
Staggs

(10) Patent No.: US 7,357,360 B2
(45) Date of Patent: Apr. 15, 2008

(54) RAIN GUTTER SWIVEL SUPPORT

(76) Inventor: Raymond Staggs, 30 Stevens St., Enfield, NH (US) 03748

( * ) Notice: Subject to any disclaimer, the term of this patent is extended or adjusted under 35 U.S.C. 154(b) by 143 days.

(21) Appl. No.: 10/950,316

(22) Filed: Dec. 1, 2004

(65) Prior Publication Data

US 2005/0252096 A1 Nov. 17, 2005

Related U.S. Application Data

(60) Provisional application No. 60/571,581, filed on May 17, 2004.

(51) Int. Cl.
*E04D 13/064* (2006.01)
*E04D 13/00* (2006.01)

(52) U.S. Cl. ..... 248/48.1; 248/282.1; 52/11

(58) Field of Classification Search ..... 52/11, 52/12, 13, 14, 15, 16; 248/48.1, 48.2, 282.1; 211/115, 116, 85.29, 90.02, 150; 312/208.1; 37/186, 187, 444, 445
See application file for complete search history.

(56) References Cited

U.S. PATENT DOCUMENTS

| | | | | | |
|---|---|---|---|---|---|
| 84,467 | A * | 12/1868 | Arter | 248/48.1 |
| 171,915 | A * | 1/1876 | Burdoin | 248/48.1 |
| 390,122 | A * | 9/1888 | Green | 248/48.1 |
| 448,550 | A * | 3/1891 | Scott | 248/65 |
| 716,841 | A * | 12/1902 | Jacoby | 248/48.1 |
| 790,217 | A * | 5/1905 | Mason | 108/1 |
| 1,002,783 | A * | 9/1911 | Sweet | 248/282.1 |
| 1,318,703 | A * | 10/1919 | Tretick | 108/5 |
| 1,508,488 | A * | 9/1924 | Tretick | 248/282.1 |
| 2,635,841 | A * | 4/1953 | Bauhammer et al. | 248/48.1 |
| 2,890,806 | A * | 6/1959 | Pilch | 414/739 |
| 3,091,055 | A * | 5/1963 | Hegedusich | 52/16 |
| 3,998,341 | A * | 12/1976 | Wolf | 414/565 |
| 4,019,290 | A * | 4/1977 | Manty | 52/11 |
| 4,185,420 | A * | 1/1980 | Medland | 52/11 |
| 4,446,658 | A * | 5/1984 | Gouin | 52/11 |
| 4,546,708 | A * | 10/1985 | Wilburth | 108/94 |
| 4,813,190 | A * | 3/1989 | Wittig | 52/11 |
| 5,490,652 | A * | 2/1996 | Martin | 248/282.1 |
| 5,590,482 | A * | 1/1997 | Peterson et al. | 37/403 |
| 6,233,876 | B1 * | 5/2001 | Obidniak | 52/16 |
| 6,854,692 | B1 * | 2/2005 | Winkel | 248/48.1 |

* cited by examiner

*Primary Examiner*—Robert Canfield
*Assistant Examiner*—Jessie Fonseca
(74) *Attorney, Agent, or Firm*—Peter A. Nieves; Sheehan, Phinney Bass + Green, PA

(57) ABSTRACT

A rain gutter swivel support is provided. A gutter retaining portion has a proximate portion having a first portion of a first connector attached thereto. The gutter retaining portion is shaped to secure a gutter. A central portion has a proximate portion, a middle portion, and a distal portion. The central portion has a second portion of the first connector attached thereto. The first connector allows the central portion and the gutter retaining portion to rotate contrary to each other. The middle portion of the central portion has a first portion of a second connector attached thereto. An anchor portion has a holding portion and a proximate portion. A second portion of the second connector is attached to a middle portion of the proximate portion. The second connector allows the anchor portion and the central portion to rotate contrary to each other.

10 Claims, 4 Drawing Sheets

RAIN GUTTER SWIVEL SUPPORT

CROSS-REFERENCE TO RELATED APPLICATION

This application claims priority to U.S. Provisional Application entitled, "RAIN GUTTER SWIVEL SUPPORT," having Ser. No. 60/571,581, filed May 17, 2004, which is entirely incorporated herein by reference.

FIELD OF THE INVENTION

The present invention is generally related to support devices, and more particularly is related to a rain gutter swivel support.

BACKGROUND OF THE INVENTION

Rain gutter supports currently in use are designed solely to provide lateral support for gutters installed on a stationary basis. They are most efficient on buildings found in tropical or moderate climates where snowfall is limited or non-existent. Unfortunately, present rain gutter supports are not efficient on buildings in environments with snow and ice.

Thus, a heretofore unaddressed need exists in the industry to address the aforementioned deficiencies and inadequacies.

SUMMARY OF THE INVENTION

Embodiments of the present invention provide a rain gutter swivel support. Briefly described, in architecture, one embodiment of the support, among others, can be implemented as follows. The support contains a gutter retaining portion, a central portion, and an anchor portion. The gutter retaining portion has a proximate portion and a distal portion, where the proximate portion has a first portion of a first connector attached thereto. The gutter retaining portion is also shaped to allow a gutter to rest therein. The central portion has a proximate portion, a middle portion, and a distal portion. The central portion has a second portion of the first connector attached thereto. The first connector allows the central portion and the gutter retaining portion to rotate contrary to each other. The middle portion of the central portion has a first portion of a second connector attached thereto. The anchor portion has a holding portion and a proximate portion, where the proximate portion of the anchor portion contains a first end and a second end, the holding portion joining the proximate portion at the first end. A second portion of the second connector is attached to a middle portion of the proximate portion. The second connector allows the anchor portion and the central portion to rotate contrary to each other.

Other systems, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention is a rain gutter swivel support capable of allowing a gutter to be retracted. As an example, the rain gutter support would be beneficial for allowing a gutter to be retracted during a time of the year when ice and snow would likely damage or destroy a typical gutter installation having stationary supports.

Figure 1:
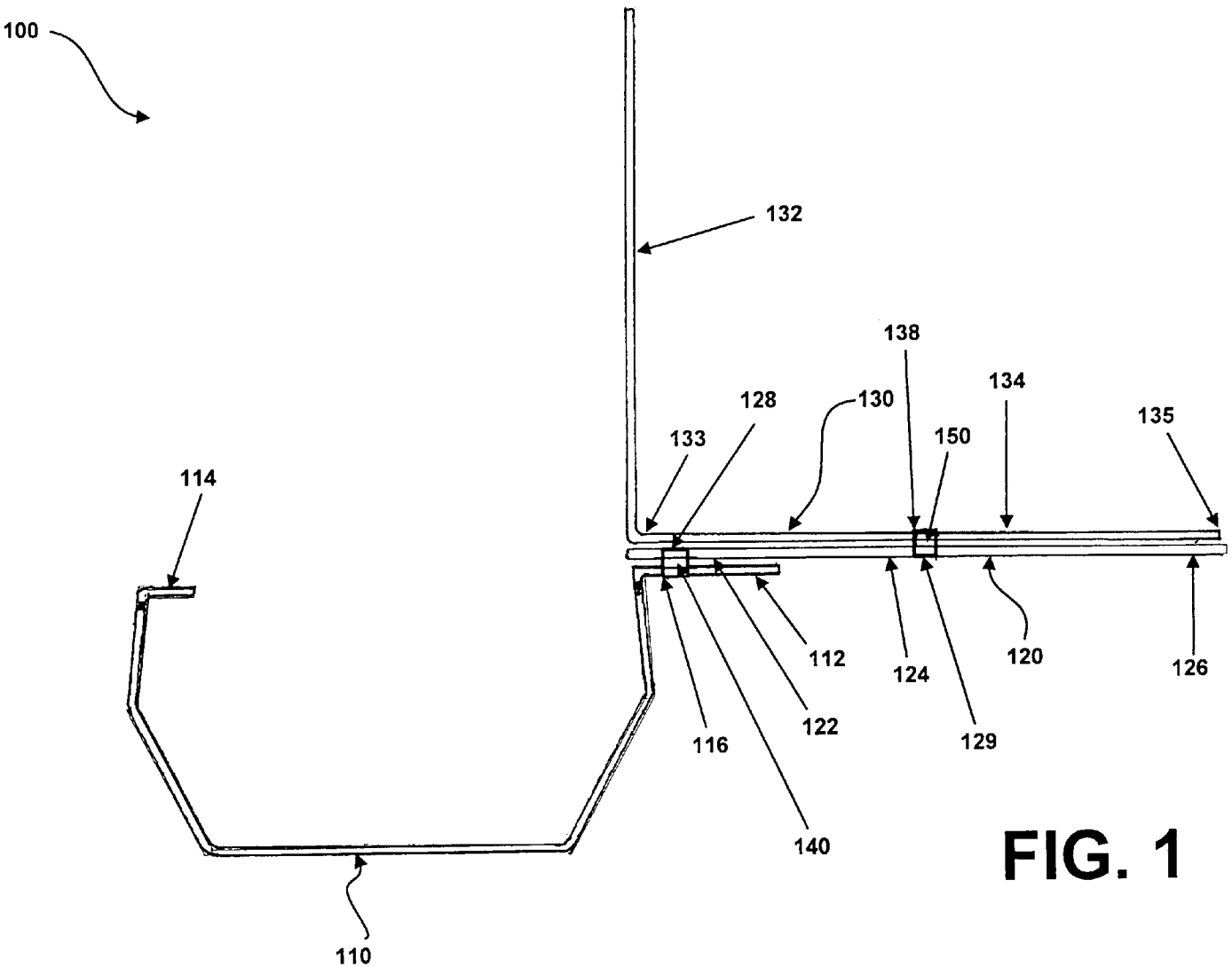
FIG. 1 is a side view of the present rain gutter support in an open position.
Figure 2:
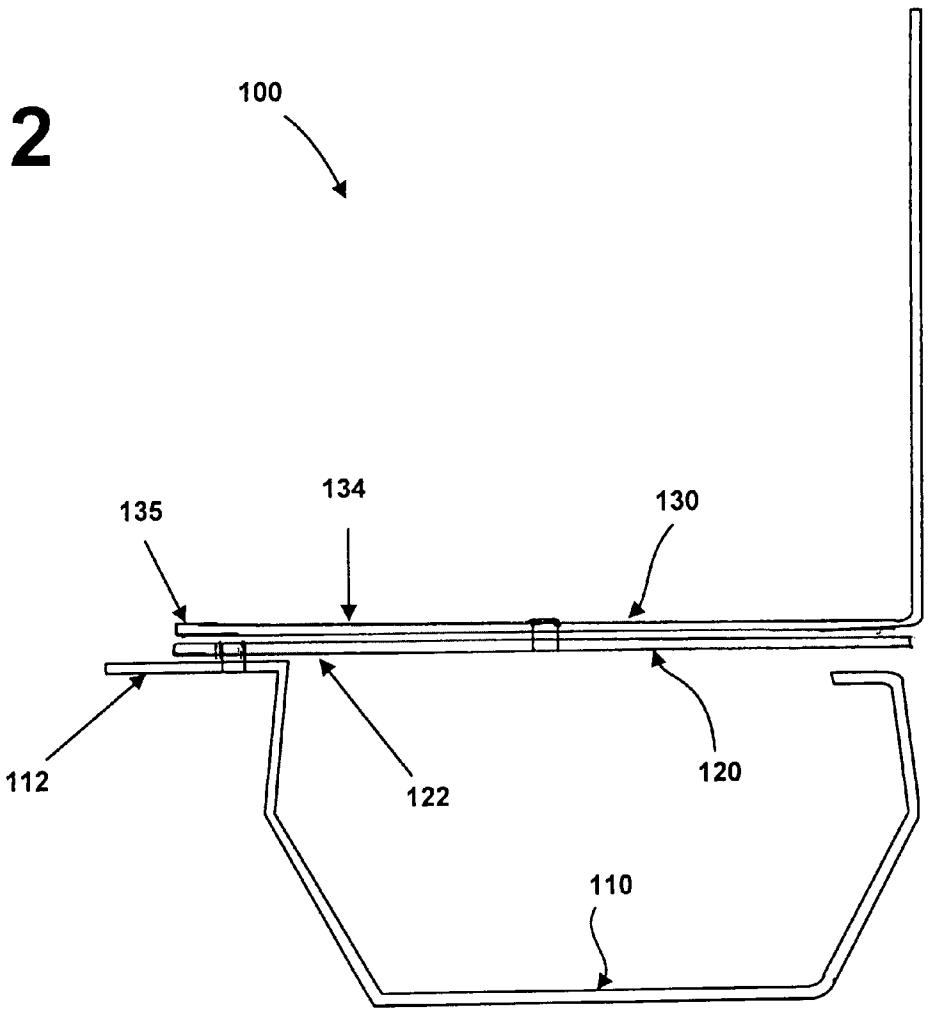
FIG. 2 is a side view of the present rain gutter support in a retracted position.

FIG. 1 is a side view of the present rain gutter support 100 in an open position, while FIG. 2 is a side view of the support in a retracted position. It should be noted that FIG. 1 is a right side view, while FIG. 2 is a left side view. Referring to FIG. 1 and FIG. 2, the rain gutter support 100 contains three portions, a gutter retaining portion 110, a central portion 120, and an anchor portion 130. The gutter retaining portion 110 is shaped to allow a typical gutter to rest therein. The gutter retaining portion 110 contains a proximate portion 112 and a distal portion 114. The proximate portion 112 of the gutter retaining portion 110 has a hole 116 therein. The hole 116 is sized to allow a portion of a first connector 140 to fit therein. As is shown by FIG. 1, optionally, the distal portion 114 of the gutter retaining portion 110 may contain a lip.

The central portion 120 of the rain gutter support 100 is elongated, having a proximate portion 122, a middle portion 124, and a distal portion 126. The proximate portion 122 has a first hole 128 therein for allowing a portion of the first connector 140 to fit therein. Via the first connector 140, the gutter retaining portion 110 is capable of continuous rotation in either direction, with or without movement of the central portion 120. Therefore, the first connector 140, and its relationship with the gutter retaining portion 110 and the central portion 120, provides a first pivoting point of the rain gutter support 100.

Figure 3:
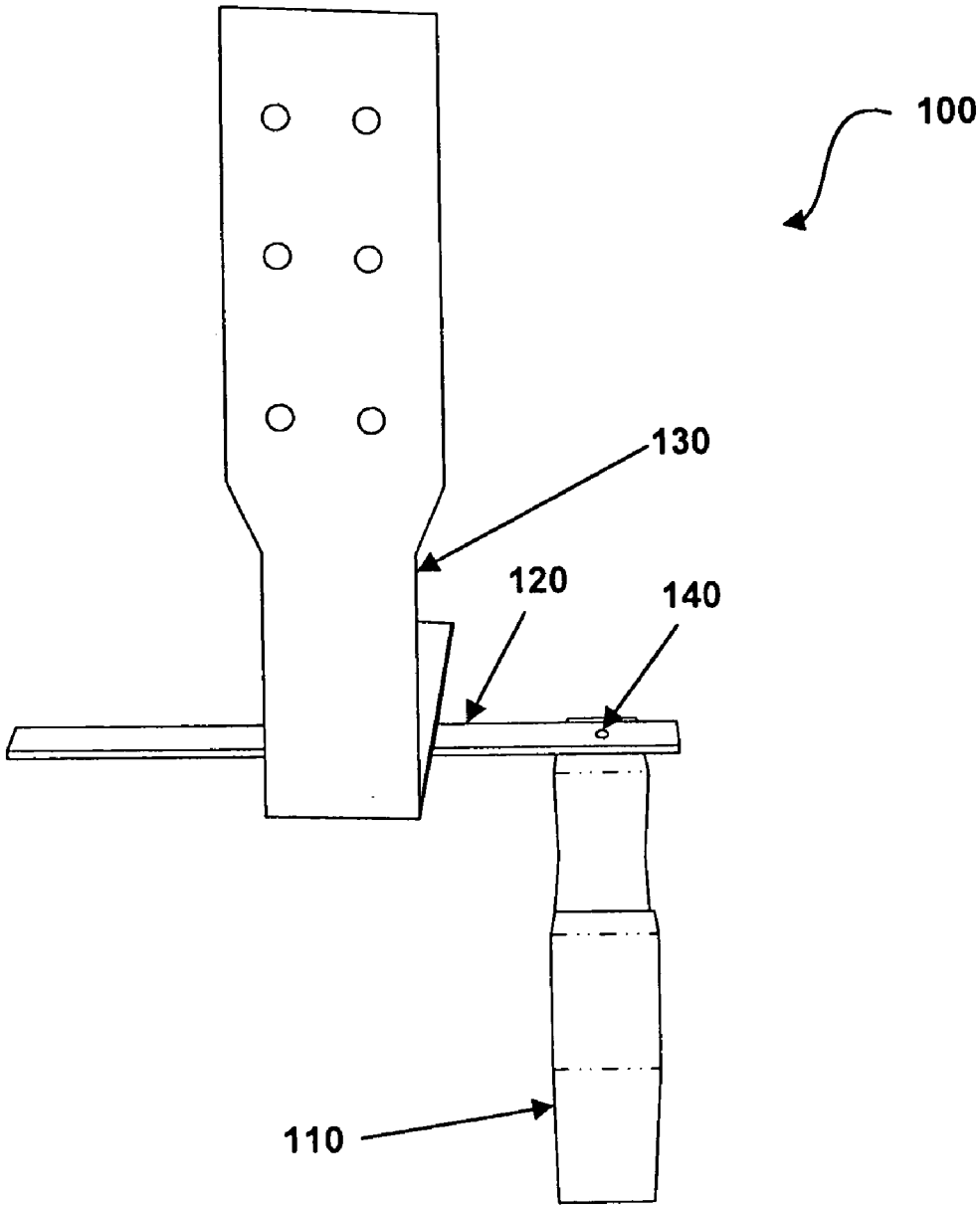
FIG. 3 is a schematic diagram illustrating the rain gutter support half way through a right swivel.

The middle portion 124 of the central portion 120 contains a second hole 129 therein for allowing a portion of a second connector 150 to fit therein. The second connector 150 extends through the second hole 129 of the central portion 120 and through a first hole 138 of the anchor portion 130, thereby providing a second pivoting point of the rain gutter support 100, as is explained in detail below. The two pivoting points of the rain gutter support 100 allow for retraction of the gutter retaining portion 110 by left or right swivel. FIG. 3 is a schematic diagram illustrating the rain gutter support 100 half way through a right swivel. This process is further described hereinbelow.

Returning to FIG. 1 and FIG. 2, the anchor portion 130 of the rain gutter support 100 contains a holding portion 132 and a proximate portion 134. The proximate portion 134 is elongated and contains the first hole 138 that extends therethrough, which is located approximately central to the proximate portion 134, although it may be located closer to a first end 133 of the proximate portion 134 or to a second end 135 of the proximate portion 134. As mentioned above, the second connector 150 extends through the first hole 138 of the proximate portion 134. The second connector 150 allows continuous rotation of the central portion 120 of the support 100 about the second connector 150, in either the right or left direction.

Figure 5:
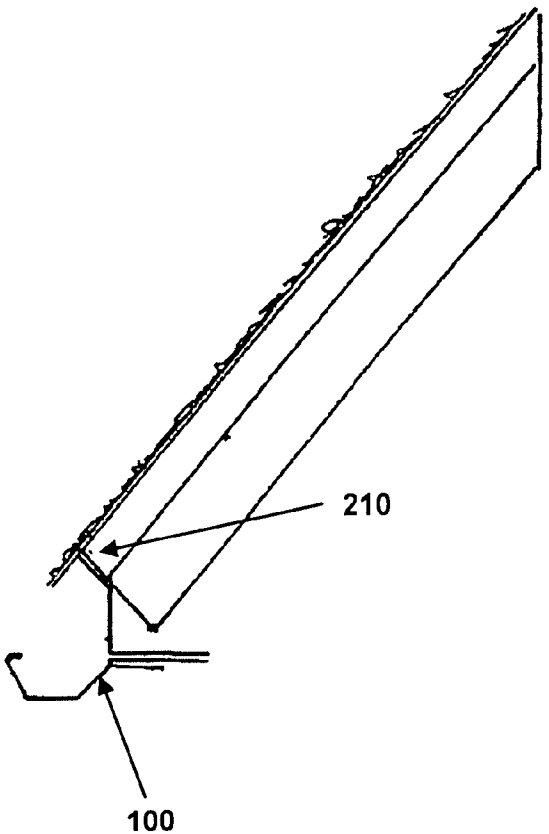
FIG. 5 is a schematic view of a support being connected to the end of a roof rafter.
Figure 4:
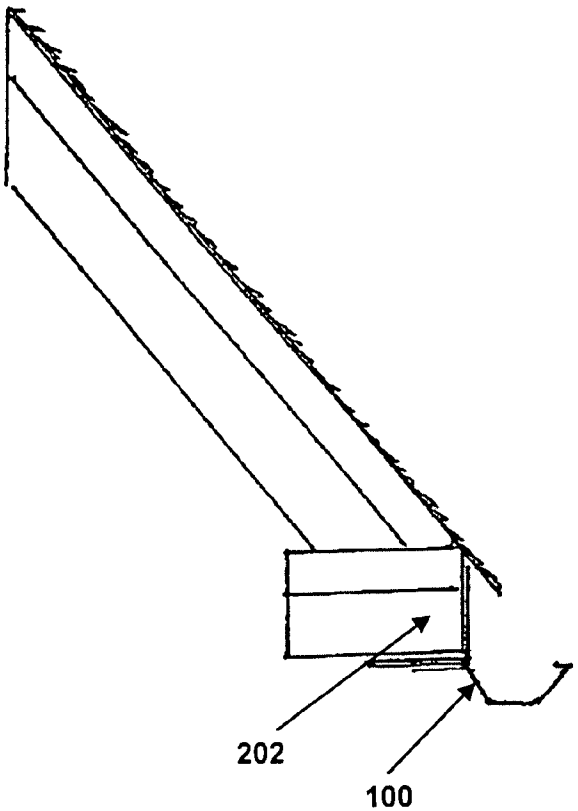
FIG. 4 is a schematic view of a support being connected to a fascia.

The holding portion 132 of the anchor portion 130 contains a series of holes for allowing securing devices, such as, but not limited to, a nail or a screw, to secure the holding portion 132 of the anchor portion 130, and therefore, the support 100, to a fascia or roof rafters. It should be noted that additional or fewer holes may be provided in the holding portion 132. FIG. 4 is a schematic view of a support 100 being connected to a fascia 202, while FIG. 5 is a schematic view of a support 100 being connected to the end of a roof rafter 210. FIG. 4 and FIG. 5 are described in further detail below.

Returning to FIG. 1 and FIG. 2, the holding portion 132 of the anchor portion 130 may be straight, where it joins the first end 133 of the proximate portion 134 of the anchor portion 130 at an angle (e.g., at ninety degrees). FIG. 4 provides an example where the holding portion 132 of the anchor portion 130 is straight. Such a holding portion would be used on buildings having a fascia and soffit. For an arrangement using the straight holding portion 132, the support 100 is attached to the fascia 202 at desired intervals with each length or partial length of gutter securely attached to the gutter retaining portion 110 of the support 100. Full and partial gutter lengths are connected together and the full length of the entire gutter is then connected to a downspout.

Alternatively, the holding portion 132 of the anchor portion 130 may used on a building that does not have a fascia and soffit. For a building without a fascia and soffit, as shown by FIG. 5, the support 100 is attached to the end of roof rafters 210 at desired intervals. Where the roof rafter end is at right angles to the ground no adjustments need to be made to the holding portion 132 of the anchor portion 130. However, where the roof rafter 210 is at a right angle to the roof line, as in FIG. 5, the holding portion 132 of the anchor portion 130 is bent to a point where the gutter retaining portion 110 is level, or parallel to the ground. The gutter may then be attached to the gutter retaining portion 110 of the support 100 and the entire gutter length may be connected to the downspout.

As mentioned above, the two pivoting points of the rain gutter support 100 allow for retraction and extension of the gutter retaining portion 110 by left or right swivel. While FIG. 1 shows the rain gutter support 100 in an open position, where the gutter retaining portion 110 projects outward, FIG. 2 shows the rain gutter support 100 in a retracted position, where the gutter retaining portion 110 is positioned beneath the central portion 120. When the rain gutter support 100 is in the open position, and when the support 100 is in the closed position, the central portion 120 and the gutter retaining portion 100 are parallel, as is shown by FIG. 1 and FIG. 2. To get from the open position to the retracted position, both pivoting points are used, thereby preventing the distal portion 114 of the gutter retaining portion 110 from having to be turned inward toward the holding portion 132 of the anchor portion 130.

When the rain gutter support 100 is in an open position, the proximate portion 112 of the gutter retaining portion 110 is positioned beneath the proximate portion 122 of the central portion 120, which is positioned beneath the first end 133 of the anchor portion 130 proximate portion 134. After swiveling, which uses both pivot points, and therefore, both the first and second connectors 140, 150, the proximate portion 112 of the gutter retaining portion 110 is positioned beneath the proximate portion 122 of the central portion 120, which is positioned beneath the second end 135 of the anchor portion 130 proximate portion 134 (i.e., the closed position). The result of swiveling is that a gutter need not be removed from the rain gutter support 100 during switching from an open position to a retracted position and from a retracted position to an open position.

For both buildings with fashia and soffit, and buildings without fascia and soffit, the support 100 allows an attached gutter to be disconnected from the gutter end or downspout, as choice dictates, and retracted, while remaining in the support 100, thus preventing damage or destruction from snow and/or ice in areas of states, countries, or continents where cold weather is a seasonal or continuing threat. Design and use of the support 100 also permits it to be used in warm or tropical climates as well as cold. Specifically, the support 100 prevents mold, mildew, and/or rot to the fascia as is sometimes the case where moisture is allowed to collect and remain for periods of time in some gutter installations.

It should be emphasized that the above-described embodiments of the present invention are merely possible examples of implementations, merely set forth for a clear understanding of the principles of the invention. Many variations and modifications may be made to the above-described embodiment of the invention without departing substantially from the spirit and principles of the invention. All such modifications and variations are intended to be included herein within the scope of this disclosure and the present invention and protected by the following claims.

What is claimed is:

1. A rain gutter swivel support, comprising:

a gutter retaining portion having a proximate portion and a distal portion, said proximate portion of said gutter retaining portion having a first portion of a first connector attached thereto, said distal portion of said gutter retaining portion comprising a U-shaped frame for receiving a gutter therein and a lip for retaining said gutter within said U-shaped frame;

a central portion having a proximate portion, a middle portion, and a distal portion, said central portion having a second portion of said first connector attached thereto, said first connector allowing said central portion and said gutter retaining portion to rotate contrary to each other, said middle portion of said central portion having a first portion of a second connector attached thereto, and said central portion being in a first plane; and an anchor portion having a holding portion and a proximate portion, wherein said proximate portion of said anchor portion contains a first end and a second end, said holding portion joining said proximate portion of said anchor portion at said first end, wherein a second portion of said second connector is attached to a middle portion of said proximate portion of said anchor portion, and wherein said second connector allows said anchor portion and said central portion to rotate contrary to each other, wherein said U-shaped frame opens upwardly toward said first plane.

2. The rain gutter swivel support of claim 1 wherein said first connector allows for said gutter retaining portion to continuously rotate in a left or right direction, with or without movement of said central portion.

3. The rain gutter swivel support of claim 1, wherein said holding portion of said anchor portion contains at least one hole for allowing a securing device to fit therethrough.

4. The rain gutter swivel support of claim 1, wherein said holding portion is bent so as to allow said gutter retaining portion to be parallel with a first surface after said holding portion is connected to a second surface.

5. The rain gutter swivel support of claim 4, wherein said surface is the ground.

6. The rain gutter swivel support of claim 4, wherein said second surface is roof rafter.

7. The rain gutter swivel support of claim 1, wherein rotation via said first connector and said second connector allows said gutter retaining portion to change from an open position to a retracted position.

8. The rain gutter swivel support of claim 7, wherein said open position is identified by said proximate portion of said gutter retaining portion being positioned beneath said proximate portion of said central portion, and where said proximate portion of said central portion is positioned beneath said first end.

9. The rain gutter swivel support of claim 7, wherein said closed position is identified by said proximate portion of said gutter retaining portion being positioned beneath said proximate portion of said central portion, and where said proximate portion of said central portion is positioned beneath said second end.

10. A rain gutter swivel support, comprising:

a gutter retaining portion having a proximate portion and a distal portion, said proximate portion of said gutter retaining portion having a first portion of a first connector attached thereto, said distal portion of said gutter retaining portion comprising a U-shaped frame for receiving a gutter therein;

a central portion having a proximate portion, a middle portion, and a distal portion, said central portion having a second portion of said first connector attached thereto, said first connector allowing said central portion and said gutter retaining portion to rotate contrary to each other, said middle portion of said central portion having a first portion of a second connector attached thereto, and said central portion being in a first plane; and an anchor portion having a holding portion and a proximate portion, wherein said proximate portion of said anchor portion contains a first end and a second end, said holding portion joining said proximate portion of said anchor portion at said first end, wherein a second portion of said second connector is attached to a middle portion of said proximate portion of said anchor portion, and wherein said second connector allows said anchor portion and said central portion to rotate contrary to each other, wherein said U-shaped frame opens upwardly toward said first plane.

* * * * *